US011631293B2

(12) United States Patent
Madani et al.

(10) Patent No.: US 11,631,293 B2
(45) Date of Patent: Apr. 18, 2023

(54) METHOD FOR CURRENCY VALIDATION

(71) Applicant: University of Louisiana at Lafayette, Lafayette, LA (US)

(72) Inventors: Mohammad Madani, Lafayette, LA (US); Daniela Siqueira Cruz, Lafayette, LA (US); Pontus Lavefalk, Lafayette, LA (US); Farhood Rasouli, Lafayette, LA (US)

(73) Assignee: University of Louisiana at Lafayette, Lafayette, LA (US)

( * ) Notice: Subject to any disclaimer, the term of this patent is extended or adjusted under 35 U.S.C. 154(b) by 106 days.

(21) Appl. No.: 17/206,268

(22) Filed: Mar. 19, 2021

(65) Prior Publication Data

US 2021/0304545 A1 Sep. 30, 2021

Related U.S. Application Data

(60) Provisional application No. 62/992,192, filed on Mar. 20, 2020.

(51) Int. Cl.
*G07D 7/005* (2016.01)

(52) U.S. Cl.
CPC ..... *G07D 7/0057* (2017.05); *G07D 7/0053* (2013.01)

(58) Field of Classification Search
CPC ..... G07D 7/0053
See application file for complete search history.

(56) References Cited

U.S. PATENT DOCUMENTS 5,818,019 A * 10/1998 Irwin, Jr ..... G06K 19/067 235/440
6,241,069 B1 * 6/2001 Mazur ..... G07D 7/04 194/207
11,423,641 B2 * 8/2022 Ross ..... G06V 10/478
2014/0263615 A1 * 9/2014 Deangelo ..... G07D 7/0043 235/375
2016/0133078 A1 * 5/2016 Hussain ..... G06K 19/06028 235/494
2016/0350996 A1 * 12/2016 Noh ..... B42D 25/328
2018/0218554 A1 * 8/2018 Blajwajs ..... G07D 7/1205
2021/0304545 A1 * 9/2021 Madani ..... G07D 7/0053

FOREIGN PATENT DOCUMENTS

WO WO-2007044570 A2 * 4/2007 ..... G07D 11/0066

* cited by examiner

*Primary Examiner* — Thien M Le
*Assistant Examiner* — Asifa Habib
(74) *Attorney, Agent, or Firm* — Kean Miller LLP; Russel O. Primeaux; Lauren J. Rucinski

(57) ABSTRACT

A concentric CRR sensor is claimed that is used as a form of currency verification in order to combat counterfeiting currency. The system comprises applying sets of concentric CRR printed with transparent conductive ink. In one embodiment, using the CRR as a passive RFID tag, changing the ring's radii, inner or outer, and in turn, created more encryption, and thereby prevents currency counterfeiting. In one or more embodiments, the serial number of the currency bill is used as a guideline to a selection algorithm to determine the size of the radii.

3 Claims, 8 Drawing Sheets

METHOD FOR CURRENCY VALIDATION

CROSS REFERENCE TO RELATED APPLICATIONS

This application claims the benefit and priority of U.S. Provisional Application No. 62/992,192 entitled "Method for Currency Validation" filed on Mar. 20, 2020.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

SUMMARY OF THE INVENTION

This invention is the design, analysis, modeling and simulation of a closed-ring resonator ("CRR") sensor which can be used as a currency validation and verification and as a chipless RFID tag. The sensor for combatting counterfeiting currency is a set of closed concentric ring resonators used as a passive chipless RFID tag printed with transparent conductive ink on a paper currency bill or bank notes. By varying the diameter of the inner ring of the concentric closed ring resonator, different resonant frequencies are observed resulting in different identifiers.

An additional security measure when implementing this sensor for currency validation is that the serial number of the currency bill can be used as a guideline to a selection algorithm to determine the size of the radii, thereby enhancing the sensor's capability to a greater selectivity and a security.

The method provides a novel design for currency validation that is unique for every individual bill. The design encodes and encrypts the serial number of each bill into the resonate frequencies of multiple invisible ring resonators printed on the bill. Deciphering the encryption of the serial number is impossible without special equipment and the decryption key that will be kept secure by the originator. This method can be applied to any important document such as smart passport, and any identification cards.

DESCRIPTION OF THE DRAWINGS

The drawings constitute a part of this specification and include exemplary embodiments of the Method for Currency Validation, which may be embodied in various forms. It is to be understood that in some instances, various aspects of the invention may be shown exaggerated or enlarged to facilitate an understanding of the invention. Therefore the drawings may not be to scale.

BACKGROUND

Figure 1A:
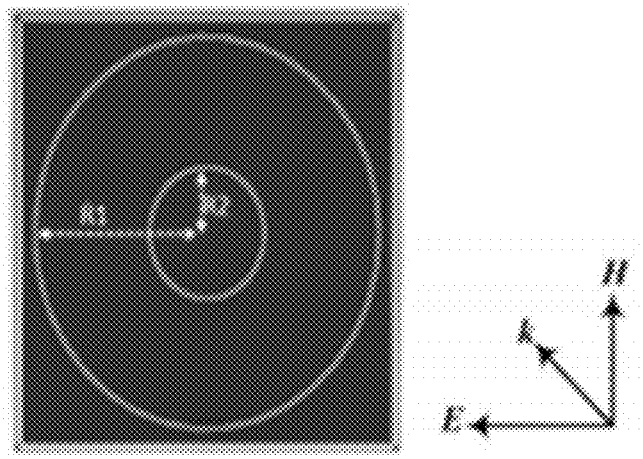
FIG. 1A is a front view of concentric CRR unit cell proposed with the directions of the magnetic field, and the electric field and incident electromagnetic wave.

Radio-Frequency Identification ("RFID") is a technology which uses electromagnetic fields to communicate between a tag and an interrogator (i.e. reader) to identify and track tags and it is gaining importance for applications for Internet of Things ("IoT"). In order to increase further acceptance and the use of RFID systems, the price of RFID tags need to be reduced since it still costs more than optical barcodes. The most common alternative for this issue is the optimization and use of chipless RFID tags. Chipless RFID tags do not have a microchip, therefore they do not require a battery, all of which would reduce the price of such device. A chipless tag is encoded in the frequency spectrum by having multiple resonant frequency peaks at predetermined frequencies, therefore creating a unique signature. The signature is obtained by interrogating the tag by a wide band signal, which then retransmits the received interrogated signal and encodes its signature in both the magnitude and phase of the frequency response.

An area of application for such a device is in combatting currency counterfeiting, which is an issue which affects every country and results in economic losses.

Attempting to counterfeit currency is frequently attempted by criminals throughout the U.S. and the World. Because of this, prevent counterfeiting is an important part of designing currency. As the counterfeiters become more competent at creating this currency, the U.S must continue to add more complex security features to make counterfeiting more difficult such as magnetic signatures, etc. One of the known features that current bills have include the material of the paper, ink that changes colours when looking at it from different angles, security ribbons that can only be seen with UV light, and watermarks that can be seen when holding the bill up to a light.

While successfully replicating all these security features is very difficult, it is still possible; especially when considering that these security measures are known to the public.

Additionally, all these features share a common flaw; that being the non-uniqueness of the features. Each bill of a certain denomination has a slightly different security design than the others, such as location of the security ribbon, the image shown by the watermark, etc. Each bill of a tier of denomination has identical security features when compared all other bills within that tier except for the serial number. This means that if a counterfeiter can successfully print one fake bill, they can produce many more. This invention proposes a solution to this problem by using invisible ring resonators printed onto the bills to create a security feature that is unique to every individual bill.

A resonator is a device that oscillates naturally with greater amplitude at certain frequencies. While there are many forms and ways to construct an oscillator, a simple way is through an inductor-capacitor (LC) circuit. When the inductor and the capacitor are connected, the resultant circuit can function as an electrical resonator. LC circuits have the capability of producing signals at a certain frequency, fr (resonant frequency) governed by equation 1, which is when the oscillation force oscillates at a higher amplitude for a specific frequency.

$$f_r = \frac{1}{2\pi\sqrt{LC}} \tag{1}$$

where L is the inductance and C is the capacitance. A single ring resonator can be represented by an LC shunt circuit and the self-inductance of a round loop according to the loop antenna theory is approximately:

$$L = \mu_0 R\left[\log\left(\frac{32R}{L_W}\right) - 2\right] \tag{2}$$

where R is the radius of the ring and Lw is conducting strip width.

Figure 1B:
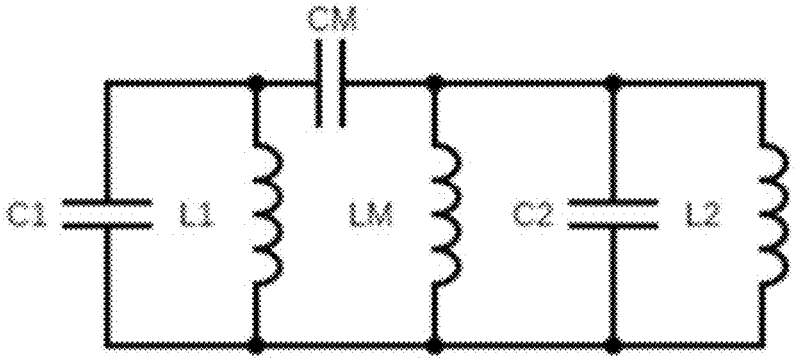
FIG. 1B shows LC equivalent circuit for two concentric CRRs.

For two concentric CRR, an electric wall is created between the two rings which leads to coupling between the LC circuits corresponding to each ring. The equivalent circuit with a mutual inductance for two concentric CRRs is represented in FIG. 1B, where C1 and C2 are the capacitances for rings with radius R1 and R2 respectively, and L1 and L2 are the rings' corresponding inductances. In addition, in FIG. 1B, CM and LM are the coupling capacitance and inductance between both CRRs.

Figure 2A:
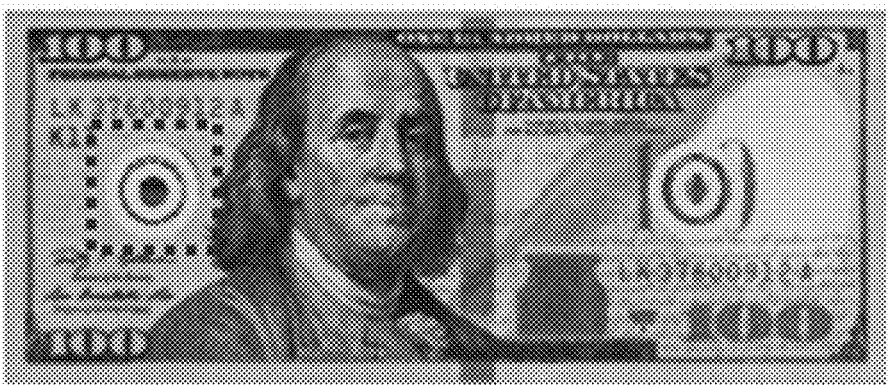
FIG. 2A shows a layout of the concentric CRR sensor bill layout with rings.
Figure 2B:
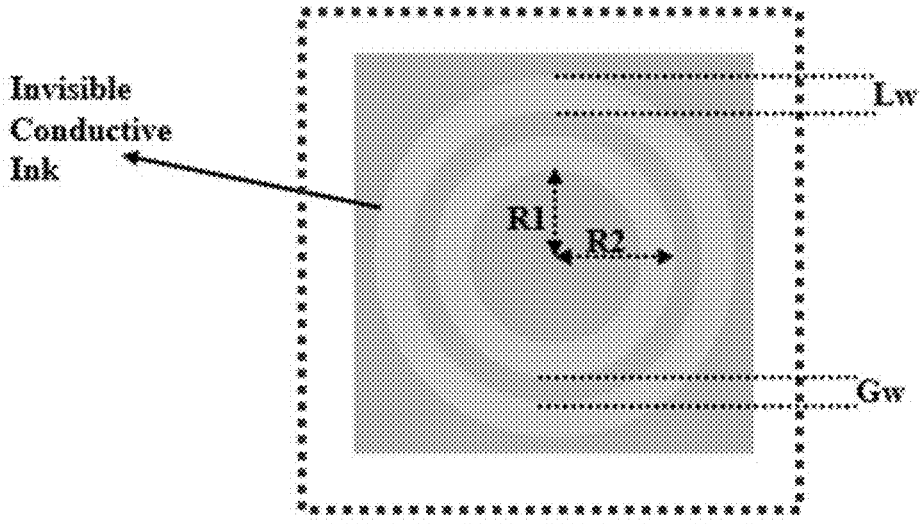
FIG. 2B shows a layout of the concentric CRR sensor schematic layout.

The mutual inductance between the outer and inner ring is approximately:

$$M' = \mu_0\left(R + G_W + \frac{3}{2}L_W\right)\left[(1-\lambda)\log\frac{4}{\lambda} - 2 + \lambda\right] \tag{2.4}$$

where $G_w$ is the gap width between both rings as seen in FIG. 2B, $\mu_0$ is the permeability of free space and $\lambda=(L_w+G_w)/2(R+G_w+1.5\,L_w)$ which is the ratio of the outer and inner ring of the device, valid when $R>>L_w$.

DETAILED DESCRIPTION

The subject matter of the present invention is described with specificity herein to meet statutory requirements. However, the description itself is not intended to necessarily limit the scope of claims.

This invention uses concentric closed ring resonators ("CRR") as a chipless RFID tag for currency validation and verification. The concentric CRRs sensor proposed is a chipless RFID tag, therefore its operation is the same as a backscattering RFID tag. Where an incident plane wave from external antennas would be applied on the tag's surface with a large range of frequencies and the response of the concentric CRRs would result on a set of resonant frequencies (i.e. unique signature) for that concentric CRRs. Therefore, by modifying a geometrical parameter of any of the rings, it leads to a change in capacitance, inductance and/or input resistance, therefore changing the overall unique signature of the concentric CRRs. In addition, for currency security applications; the serial number of the currency bill can be used as a guideline to a selection algorithm to determine the size of the radii, this would add an additional security measure to the proposed concept. In one embodiment, the concentric CRR sensor's geometrical parameter which was changed for simulation was the inner ring's radius, while maintaining the outer radius constant.

In one embodiment, the design for a sensor which can be used as an RFID tag to combat currency counterfeiting consists of a set of concentric CRR sensor composed of two individuals concentric CRR (FIG. 2A) apart by 6.5 cm from their outer diameters and backed by a transmission line with the same line thickness as the ring's line width (Lw). All the conductive lines may be printed using inkjet printing techniques. For example, the parameter recommendations from Table 1 with TCF-30 ink by NanoIntergris Inc. is used due to its 90-91% transmittance. Lw=0.454 mm, the height was selected as 0.035 μm and the gap between the rings (Gw) varied between 0.65 cm to 0.15 cm depending on the size of R1.

TABLE 1

| Parameter | Recommendation |
|---|---|
| Jetting Frequency | 5 kHz |
| Drop Velocity | 8 m/s |
| Printhead Temperature | 40° C. |
| Stage Temperature | 30° C. |
| Curing Temperature | 150° C. |
| Curing Time | 30 minutes |

In one embodiment, the serial number of the currency bill is used as its guideline to determine the size of the radius, where the first four digits after the letters would indicate the size of the outer ring's radius, and the inner radius would be selected accordingly.

In one embodiment, R1 would be a static 1 cm and the same for all simulated sensors, however R2 can be varied from 0.35 cm to 0.85 cm which would lead to different channels, i.e. unique signatures. The substrate in the preferred embodiment is a currency bill. However, in other embodiments, the substrate is paper, for example, with dielectric constant of 2.31.

Figure 9:
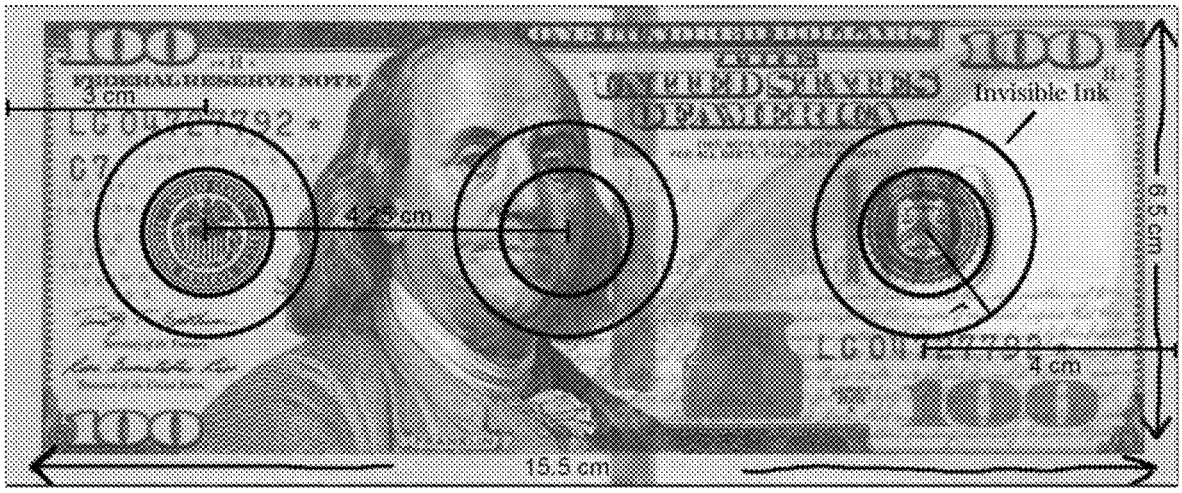
FIG. 9 depicts a hundred-dollar bill with three resonators with r=1.5 cm.

Ring resonators with specific design characteristics will be printed onto a bill with invisible conductive ink at specific locations on the bill. FIG. 9 is an illustration of the design of the bill with three ring resonators.

To create an unique resonate frequencies for each bill, the radius of the inner rings will be changed up to the experimental minimum and maximum usage radiuses. The theoretical number of unique identifiers that this system can create is:

$$N=((f_{max}-f_{min})/\Delta f)^n \tag{3}$$

where $f_{max}$ and $f_{min}$ are the maximum and minimum experimental resonate frequencies respectively generated by a given fixed outer ring radius and variable inner ring radiuses, n is the number of resonators used, and Δf is the channel width.

As shown in Equation 3, lowering Δf will yield more combinations and thus is the limiting factor for the number of possible combinations. Two variables limit what Δf can be, one is the resolution of the printer $R_p$ being used and the other is the accuracy of the reader $R_r$ used to read the resonators; whichever device has a worse accuracy/resolution limits the maximum possible combinations. Taking this into consideration the number of possible identifiers can be rewritten as:

$$N=((R-W_{min})/R_p)^n \text{ when } R_p>R_r \quad (3.1)$$

$$N=((R-W_{min})/R_r)^n \text{ when } R_r>R_p \quad (3.2)$$

where R is the radius of the outer ring, $W_{min}$ is the line width of the rings, and n is the number of resonators being used.

High quality printers can be found with resolutions as high as 9600 dpi. One such printer is the CNMIX6820—Canon PIXMA iX6820 Inkjet Printer. The maximum number of unique identifiers using a 9600 dpi printer and the maximum and minimum inner ring radius shown in Table 4.

TABLE 2

| Number of Ring Resonators | Ring Line Width | Outer Ring Radius | # of unique Identifiers |
|---|---|---|---|
| 1 | 0.454 mm | 1.5 cm | 3,401 |
| 2 | 0.454 mm | 1.5 cm | 11,566,801 |
| 3 | 0.454 mm | 1.5 cm | $3.9339 \times 10^{10}$ |
| 4 | 0.454 mm | 1.5 cm | $1.3379 \times 10^{14}$ |

As shown in Table 4, utilizing three resonators with an outer ring radius of 1.5 cm yields enough combinations to easily account for all $100 bills in circulation. By utilizing four rings the system can easily account for every single bill in circulation.

Figure 10:
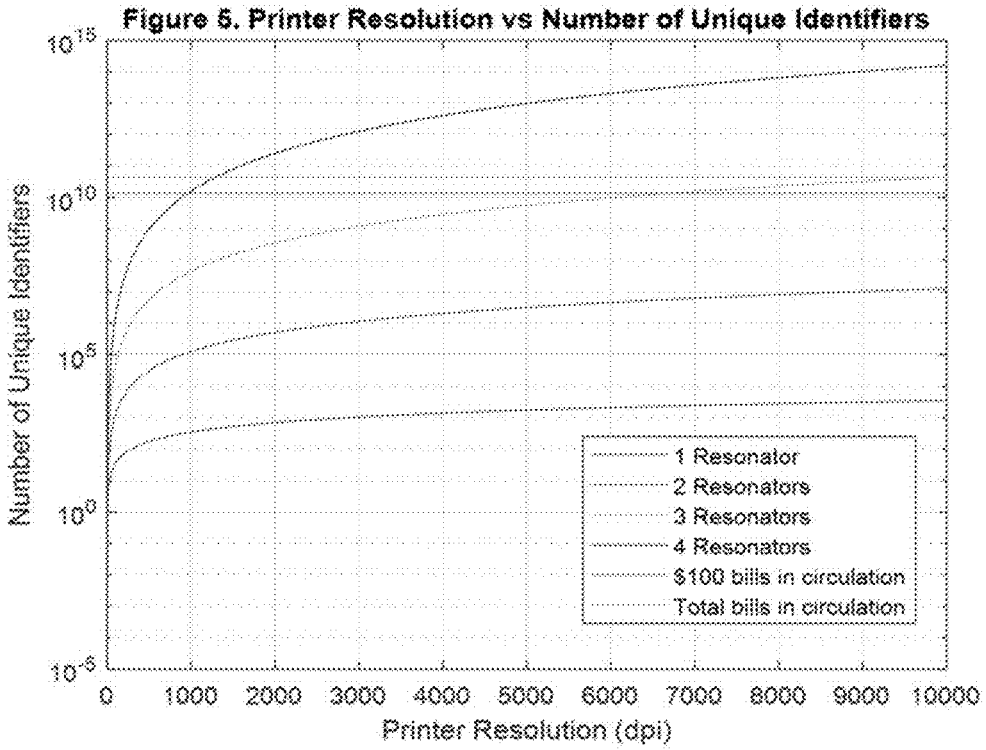
FIG. 10 is a graph of Printer Resolution vs Number of Unique Identifiers.

The number of real possible identifiers is heavily limited by the resolution of the printer. FIG. 10 shows the relationship between printer dpi vs number of unique identifiers.

In other embodiments, the realistic maximum number of unique identifiers is limited by the maximum resolution of the printer and the range of usable inner ring radiuses (determined experimentally). This quantity can be expressed as, $$MaxIdentifiers = \left(\frac{r_{max} - r_{min}}{R}\right)^n$$

where $r_{max}$ and $r_{min}$ are the maximum and minimum usable inner ring radius, R is the printer resolution, and n is the number of resonators used.

Table 3 shows the usable frequency range and inner ring radius for resonator with an outer ring radius of 1.5 cm.

TABLE 3

| Radius (mm) | Resonance (GHz) |
|---|---|
| 3 | |
| 4 | |
| 5 | 7.71 |
| 6 | 6.54 |
| 7 | 5.64 |
| 8 | 4.95 |
| 9 | 4.425 |
| 10 | 4.02 |
| 11 | 3.69 |
| 12 | 3.42 |
| 13 | 3.21 |
| 14 | 2.97 |

The maximum and minimum frequencies in this case are 7.71 GHz and 2.97 GHz respectively as shown in Table 3.

Once the encrypted serial numbers are converted to frequencies, they are converted to the corresponding inner ring radius that will yield the desired frequency. The device reading the bills will have access to a database that lists the frequencies of all possible rings to their encrypted serial number. When the reader scans a bill, it will verify that the encrypted serial matches the serial number on the bill; if the numbers do not match, the bill is counterfeit.

Each individual bill has a unique 8-digit serial number in it. In one embodiment, this system splits the serial number into different parts evenly based on the number of ring resonators used.

For example, if two resonators are being used, serial number is divided into two four-bit numbers. Once the serial number is divided, the algorithm encrypts the new numbers using RSA encryption and maps these encrypted serial numbers to the appropriate frequency range derived from the experimental data using the following Equation 4 to determine the resonance frequency, F:

$$F=[(I-I_{min})*(f_{max}-f_{min})/(I_{max}-I_{min})]+f_{min} \quad (4)$$

where $f_{max}$ and $f_{min}$ are the maximum and minimum experimental resonate frequencies found in Table 3, I is the number being encrypted, and $I_{min}$ and $I_{max}$ are the minimum and maximum values for I.

Once the encrypted serial numbers are converted to frequencies, they are converted to the corresponding inner ring radius that will yield the desired frequency using the equation found from experimental data. For a ring with an outer radius of 1.5 cm, the inner ring radius R is determined experimentally:

$$R=45.3067/(f*10^{-9})^{500/463} \quad (5)$$

Figure 11:
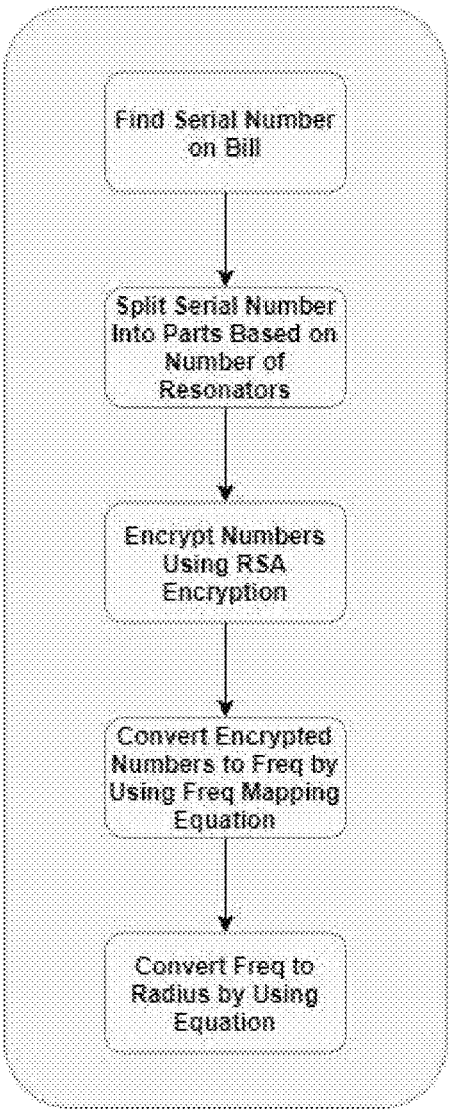
FIG. 11 is a flow diagram for the encryption process.

Once this value is calculated then the resonator can be printed onto the bill. FIG. 11 shows the flow chart for converting a serial number to a usable radius. When the reader scans a bill, it will verify that the encrypted serial number matches the serial number on the bill; if the numbers do not match, the bill is counterfeit.

The device reading the bills can convert and decrypt the resonate frequencies using the decryption key generated through the RSA algorithm. However, this means that if the device were to be hacked and the decryption key was found, it would be theoretically possible to replicate the resonators. To avoid this, the device will simply only have access to a database that lists the frequencies of all possible rings and which encrypted serial number they correspond with. Because the database will not contain any information on how to decrypt the serial number, it is not feasible to crack the encryption algorithm with only the information found within the reading device. For a counterfeiter to be able to somewhat effectively replicate the process, they would need to obtain the top-secret encryption key which would be held by the government. Because replicating this system requires infiltration into top-secret government information, the system is more secure than current existing security features used in currency.

Example 1

Figure 3:
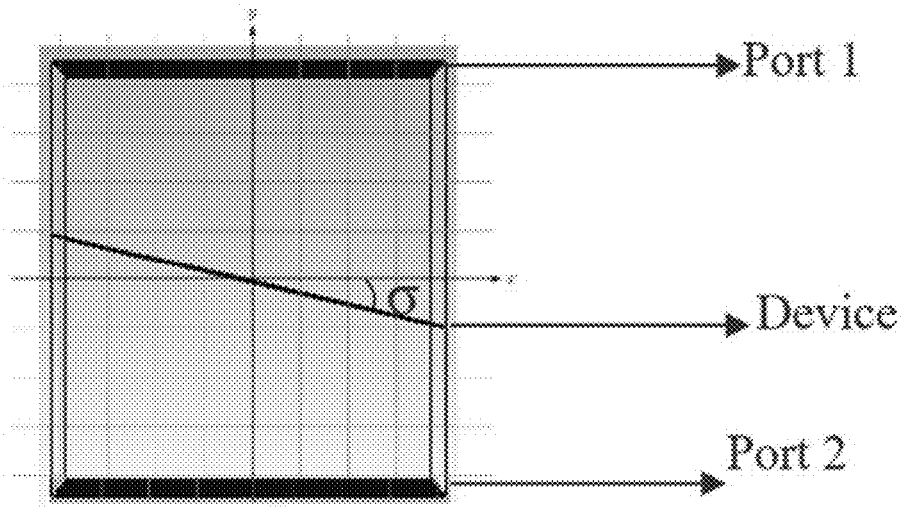
FIG. 3 is a top view of the device and the port with the angle of rotation of the device (a) being depicted.

In order to determine if the concentric CRR could be used as RFID tags, this example shows the versatility of reading the unit cell in various directions. One of the characteristics of RFID is that the tag does not need to be in the line of sight of the reader. For this example configuration, it was necessary to rotate the structure by σ degrees (from 0 to 90 degrees) while keeping the ports constant as it is illustrated in FIG. 3, therefore simulating that the tag varies from being in parallel with the port to being almost perpendicular to it.

Figure 4A:
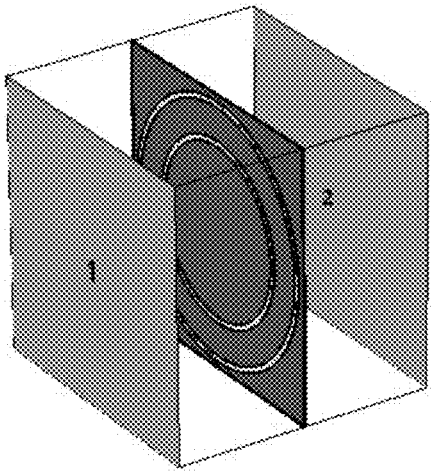
FIG. 4A depicts a model built in CST Studio Suites for simulation of a concentric CRR waveguide port configuration.

The example configuration for the concentric CRR consists of two signal ports, waveguide port 1 and waveguide port 2. The concentric CRR is positioned at the center between the two ports away from each port by 15 mm. FIG. 4A depicts the model for a concentric CRR in CST with the ports labeled. Each concentric CRR was simulated in air, and the top layers surrounding the rings of the concentric CRR a composed of a PEC (perfect electric conductor) material.

Figure 4B:
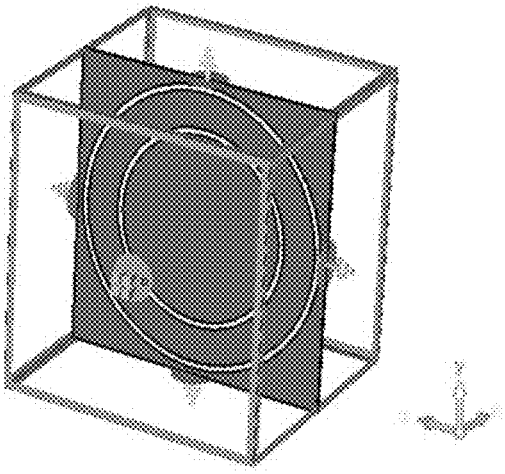
FIG. 4B depicts a model built in CST Studio Suites for simulation of a concentric CRR boundary selection.
Figure 5:
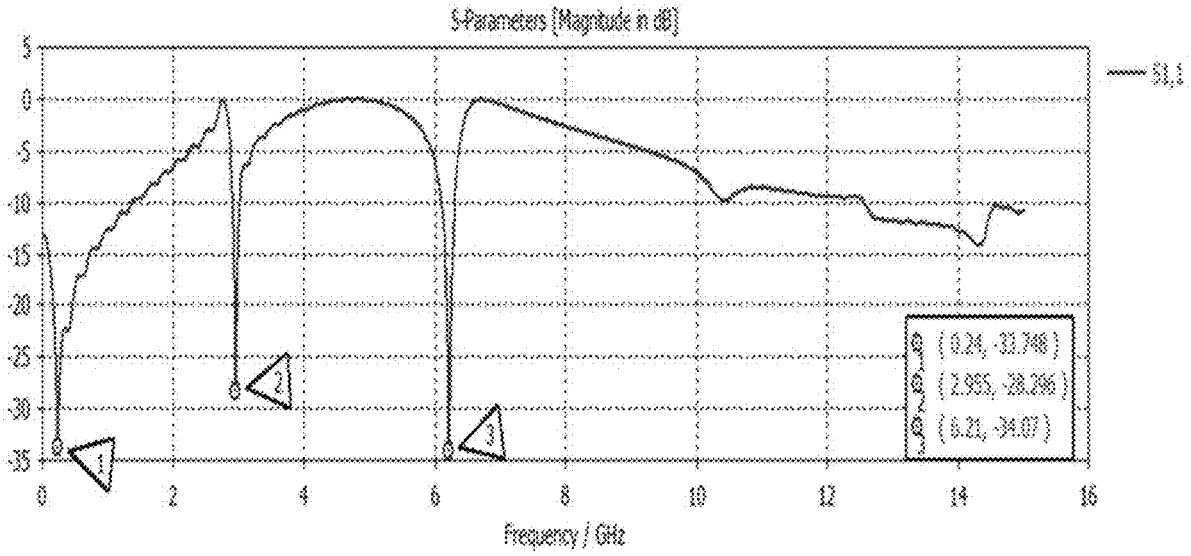
FIG. 5 depicts S-Parameter for concentric CRR for R2=1 cm, R1=0.5 cm and σ=20o (dB/GHz).

The substrate used for this example has a dielectric constant of 2.31, which is the value for paper. As observed in FIG. 4B the X-plane is defined as a Perfect Electric Boundary (PEB) and Y-plane as a Perfect Magnetic Boundary (PMB). The frequency range for the example is from 0 to 15 GHz. Each simulation of the tag's rotation resulted in deep S11 and S21 peaks apparent, one example of the S11 plot is shown in FIG. 5, where the outer radius is 1 cm, the inner radius is 0.5 cm and the angles of rotation, σ was 20 degrees. All peaks are visible at the correct and expected frequencies, and their reflection coefficients are significant.

Each peak at predetermined frequencies creates a unique identifier signature, therefore allowing for the concentric CRR to be used as a chipless RFID tag. For the peaks shown in FIG. 5, peak 1 would represent digit 1, peak 2 would represent digit 2 and peak 3 would represent digit 3. Thus, this tag could be identified as having the following signature identifier: 0.24, 2.95, 6.21, while a tag with a different resonant frequency peak would have a completely different signature identifier.

Figure 6:
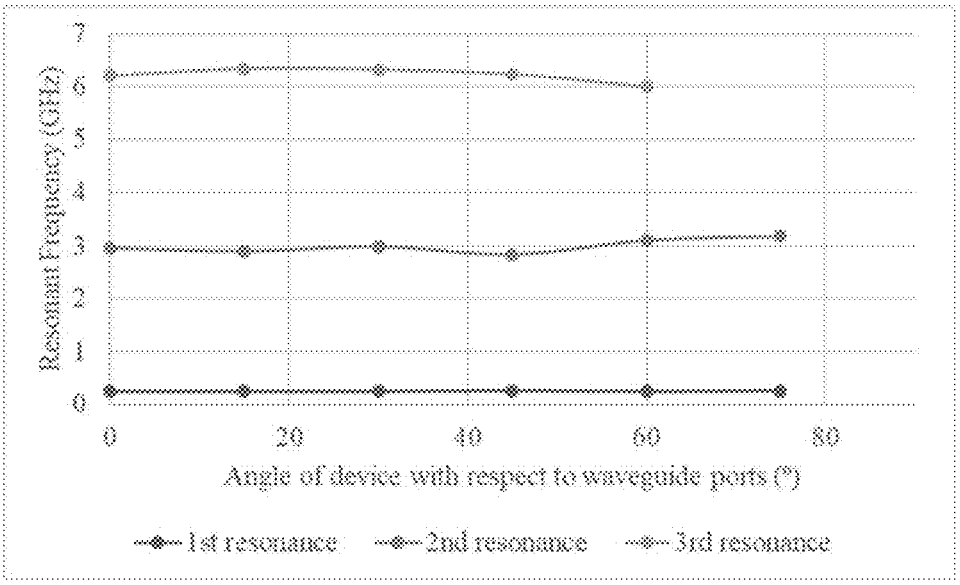
FIG. 6 is a graph of angle of rotation of device with respect to the port versus resonant frequency plot (GHz/o).

After rotating the concentric CRR structure as shown in FIG. 3, the values for the resonances remained constant for most angles of rotation, a. However, the third resonance stopped appearing after 60° as seen in FIG. 6. For the money validation application where the reader would be stationary this is a valid option.

Example 2

Figure 7A:
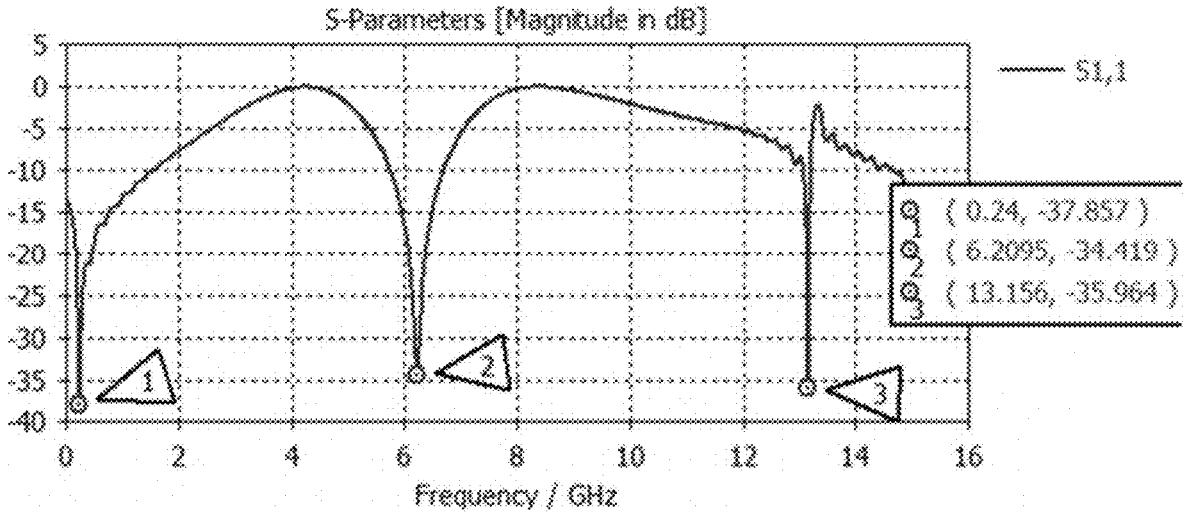
FIG. 7A depicts S-Parameter plot for R1=1 cm and R2=0.65 cm (dB/GHz).
Figure 7B:
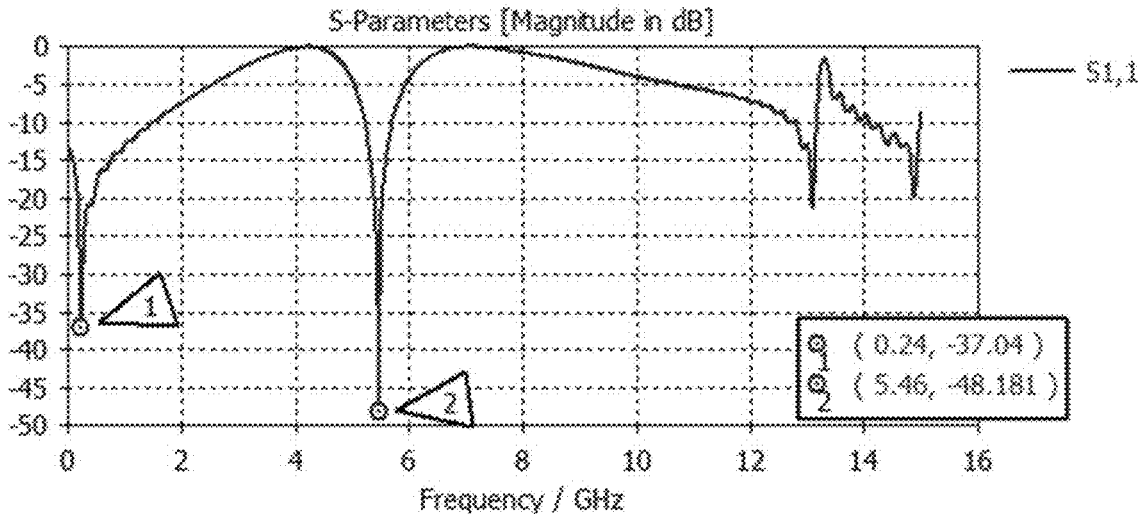
FIG. 7B depicts S-Parameter plot for R1=1 cm and R2=0.75 cm (dB/GHz).

This example shows what geometrical parameter will be modified to produce unique identifiers. It was determined that by changing the ring's radius it would lead to changes in the resonant frequencies band, therefore the EM simulation constructed varied the ring's radius. This example was configured so that the inner ring's radius, R2 would be changed while maintaining the outer radius, R1 constant and monitoring the resonant frequencies response. A large variation of the inner ring's radius was conducted, and two of the simulations' reflection coefficient plots are show in FIG. 7 where R1 is 1 cm and R2 is 0.65 cm for (A) and R2 is 0.75 cm for (B). FIG. 7 show that by changing the inner ring's radius there is change in one of the resonant frequency channels, from 6.21 GHz in (A) to 5.46 GHz in (B).

Figure 8:
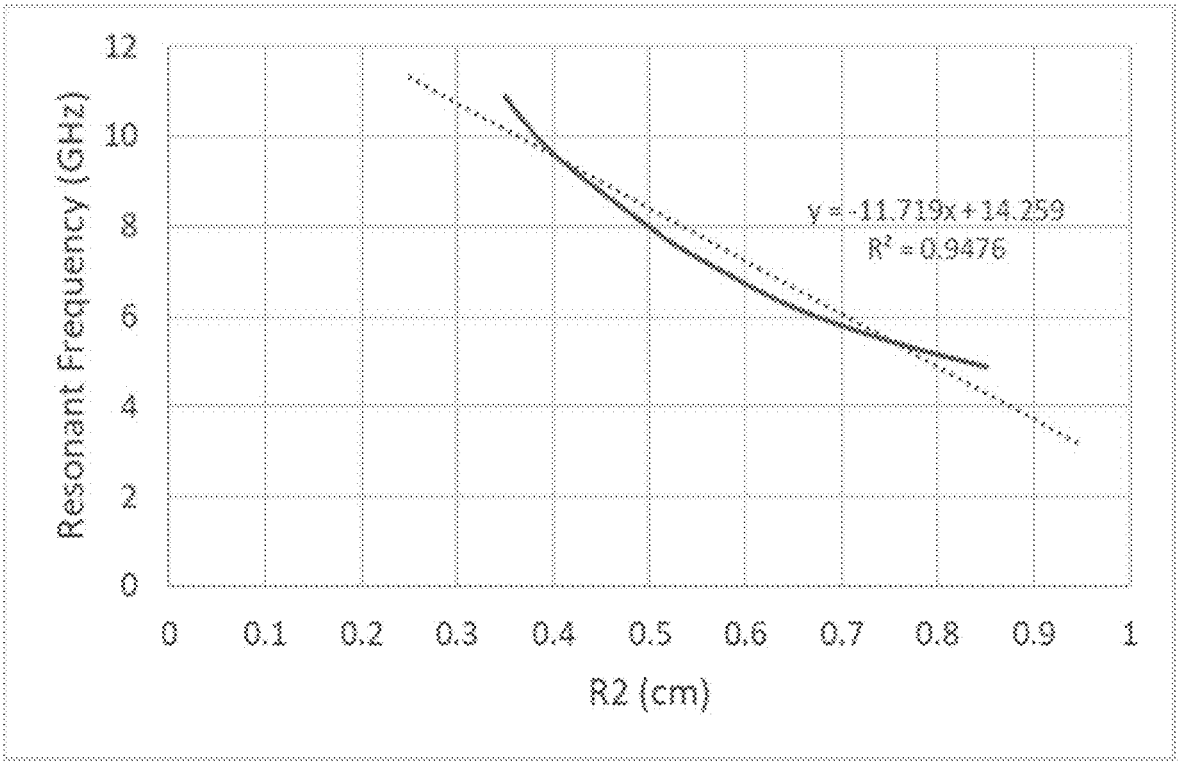
FIG. 8 is a graph of resonant Frequency vs outer radius (R2) graph with its R2 and its equation displayed (GHz/cm).

This example of the concentric CRRs with R1 being held constant and R2 varying demonstrated a downward trend of the resonant frequency as the R2 increases, as seen in FIG. 8, which depicts the trend for the second resonant frequency band. The R2 of this data is 0.9476, which demonstrates a high correlation between the radius size and the resonant frequency.

The example conducted demonstrates that when R1 is 1 cm and R2 is within 0.35 cm and 0.85 cm there is 6 GHz bandwidth available. Therefore, if the reader system, which would be embedded on currency detector devices available has an accuracy of 1 KHz, then there are 6×106 possible unique signature identifiers per concentric CRR due to one resonant frequency band being modified. By adding an extra set of concentric CRR on the opposite end of the currency bill, as illustrated in FIG. 2, the unique signature identifier variation of one band increases to 6×1012 possibilities, more than enough to differentiate the dollar bills currently available.

Example 3

Knowing that each peak at predetermined frequencies creates a unique identifier signature and that due to changes in the inner radius there are 6×106 possible unique signatures, the outer radius, R1, was also be changed, therefore modifying the other peaks and allowing for more unique identifier signatures. In addition, for currency security application, by using the serial number of the currency bill as a guideline to a selection algorithm to determine the size of the radii, an additional security feature would be implemented. By combining changes in the inner and outer ring's radius, in addition to having two sets of concentric CRR, this invention provides an enormous amount of available tags for combatting currency counterfeiting.

For the purpose of understanding the Method for Currency Validation, references are made in the text to exemplary embodiments of an Method for Currency Validation, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

The invention claimed is:

1. A currency sensor comprising:

a. two concentric closed ring resonators, one outer and one inner, each comprising a ring line width, and each located on a bill; and b. a transmission line having the same thickness as the rings line width;

wherein the serial number of said bill corresponds to the size of at least one of said two concentric close ring resonators; and wherein said outer concentric closed ring resonator comprises a line width equal to said transmission line thickness.

2. The currency sensor of claim 1 wherein said plurality of concentric closed ring resonators are printed on said bill with an inkjet printer.

3. A method for identifying billed currency comprising:

a. determining the serial number of a bill;

b. dividing said serial number into a plurality of parts;

c. encrypting said plurality of parts;

d. converting said encrypted plurality of parts each to a frequency so as to generate a plurality of frequencies;

e. converting each of said plurality of frequencies into a radius measurement so as to generate a plurality of radius measurements; and f. applying a plurality of concentric closed ring resonators to said bill, each outer most said concentric closed ring resonator having a radius corresponding to at least one of said plurality of radius measurements.

* * * * *